United States Patent [19]

Tsuruta et al.

[11] 3,977,670

[45] Aug. 31, 1976

[54] DEVICE FOR SEPARATING STACKED SHEETS

[75] Inventors: Masao Tsuruta, Minami-ashigara; Shigeki Sakate, Fujimiya, both of Japan

[73] Assignee: Fuji Photo Film Co., Ltd., Minami-ashigara, Japan

[22] Filed: May 27, 1975

[21] Appl. No.: 581,096

[30] Foreign Application Priority Data

May 30, 1974 Japan ..... 49-61248

[52] U.S. Cl. ..... 271/207; 34/150; 271/105; 271/221

[51] Int. Cl.[2] ..... B65H 31/34

[58] Field of Search ..... 271/207, 210, 211, 221, 271/195, 177, 146, 145, 30 A, 105, 97, 276, 98, 108, 149, 214, 222; 34/150; 214/6 S

[56] References Cited

UNITED STATES PATENTS 2,890,885 6/1959 Harvey ..... 271/210

3,198,519 8/1965 Bartsch ..... 271/210 X 3,411,772 11/1968 Rovin ..... 271/195 X

*Primary Examiner*—Evon C. Blunk

*Assistant Examiner*—Bruce H. Stoner, Jr.

*Attorney, Agent, or Firm*—Gerald J. Ferguson, Jr.; Joseph J. Baker

[57] ABSTRACT

Under a sheet holder in which a stack of vertically oriented sheets are accumulated in the horizontal direction, a rotary air blower is provided to apply an air blow on the lower side of the stack of sheets to separate them. The cylindrical face of the rotary air blower is provided with a number of air nozzles arranged regularly to effect periodical air blow onto the side of the stack of sheets. The sheet holder is preferably inclined so that the separated sheets may automatically be aligned.

14 Claims, 5 Drawing Figures

DEVICE FOR SEPARATING STACKED SHEETS

BACKGROUND OF THE INVENTION

1. Field of the Invention

This invention relates to a device for separating stacked sheets, and more particularly to a device for separating photosensitive sheet material accumulated in a stack.

2. Description of the Prior Art

In the manufacture of photosensitive sheet materials such as X-ray film, comparatively large sized photographic film and so forth, it is often required to separate stacked sheets. Particularly, in the process of cutting the sheet material and the process of cutting the corners thereof to round them, the stacked sheets are likely to stick to each other and prevent smooth separation thereof. Sheets of photosensitive sheet material bearing a photographic emulsion layer are particularly apt to stick together since the surface of the emulsion layer is likely to be tacky.

In order to separate the stacked sheets, it has been known in the art to use an air blow as disclosed in Japanese Pat. No. 27249/1969. In this patent, a number of air blowing ports are provided on three sides of a stack of sheets on a sheet holder which is vibrated in the horizontal direction, and an air blow is applied to the edge of the stacked sheets to separate the sheets. This method of separating the sheets is disadvantageous in that the force acting to separate the sheets is weak since the cross sectional area of the air blowing ports is large, and a number of ports must be provided accordingly. Further, since the sheets are horizontally oriented and stacked vertically, the sheets in the uppermost part of the sheet stack are apt to be blown away by the air blow, and the sheets in the lower part of the sheet stack are far more difficult to separate than those in the upper part thereof. In addition, manual operation is required to align the sheets after separation.

It has also been known in the art to separate stacked sheets by a mechanical device as disclosed in Japanese Pat. No. 9061/1969. In this patent, it is disclosed to provide a movable member underneath a stack of sheets which are vertically oriented and accumulated in the horizontal direction so that some of the stacked sheets may be moved upward by the movable member as the member moves horizontally along the lower edge of the sheets. The movable member is screw-engaged with a screw rod extending perpendicular to the face of the sheets and moved along the lower side of the stack of the sheets by the revolution of the screw rod. This method of separating the stacked sheets is disadvantageous in that the lower edges of the sheets are apt to be scratched by the movable member since the movable member is moved in contact therewith. Further, this mechanical sheet separating device has a defect in that the speed of operation cannot be increased beyond a comparatively low speed.

SUMMARY OF THE INVENTION

In view of the above-mentioned observations and description of the conventional devices for separating stacked sheets, the primary object of the present invention is to provide a device for separating sheets accumulated in a stack wherein the sheets are effectively separated without manual operation.

Another object of the present invention is to provide a device for separating sheets accumulated in a stack in which the sheets are not scratched during the separating operation.

Still another object of the present invention is to provide a device for separating sheets accumulated in a stack which can be operated at a high speed.

A further object of the present invention is to provide a device for separating sheets accumulated in a stack wherein the sheets are automatically aligned with each other at the same time they are separated.

The above objects are accomplished by providing a rotary air blowing cylinder under a stack of sheets which are vertically oriented and accumulated in the horizontal direction. The rotary air blowing cylinder is rotatable about a shaft extending in parallel to the face of the sheets. The sheets are supported vertically and the stack of sheets is limited at its ends by a pair of end plates.

In accordance with the present invention, the sheets are separated at a high speed since the air blow applied from the lower side of the stack thereof is given by a rotary air blowing cylinder which imparts the air blow while swinging the direction thereof through an arc. Further, since the air blow is supplied by a rotary air blowing cylinder which is provided with a number of air nozzles arranged regularly at equal intervals over the face of the cylinder, the air blow is applied to the stack of sheets periodically at a predetermined frequency and consequently the sheets are vibrated in the sheet holder and automatically aligned with each other.

DESCRIPTION OF THE PREFERRED EMBODIMENTS

Figure 1:
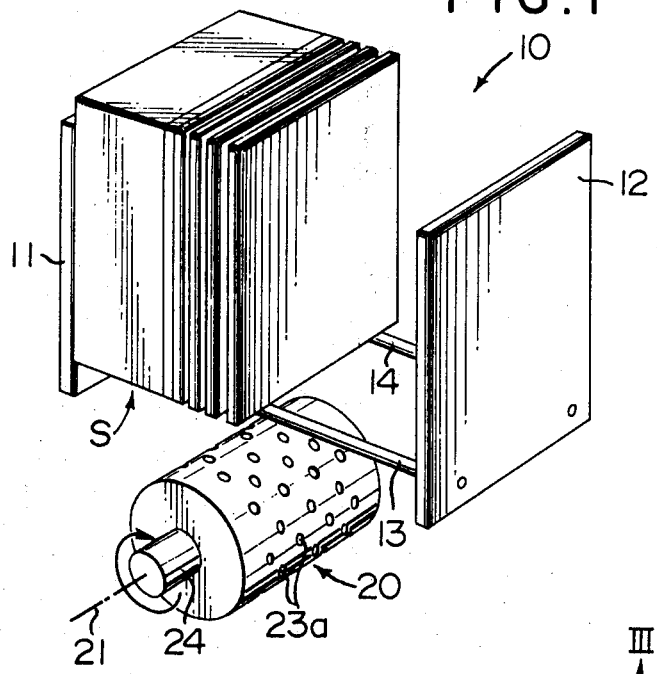
FIG. 1 is a perspective view schematically showing the essential structure of an embodiment of the present invention.

The essential structure of the device for separating sheets in accordance with the present invention is illustrated in FIG. 1. A sheet supporting holder 10 is constituted of a pair of end plates 11 and 12 which extend vertically in parallel to each other and a pair of support bars 13 and 14 extending between the end plates and fixed at opposite ends thereto. Under the sheet supporting holder 10 is located a rotary air blowing cylinder 20 rotatable about an axis 21 extending in parallel to said end plates 11 and 12.

The rotary air blowing cylinder 20 is provided with a number of air nozzles 23a on the cylindrical face thereof as shown in FIG. 1. The rotary air blowing cylinder 20 is illustrated in detail in FIGS. 2 and 3.

Figure 2:
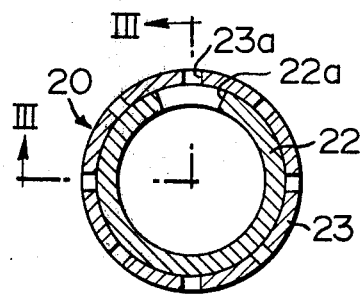
FIG. 2 is a cross sectional view of a rotary air blowing cylinder employed in the sheet separating device in accordance with the present invention.
Figure 3:
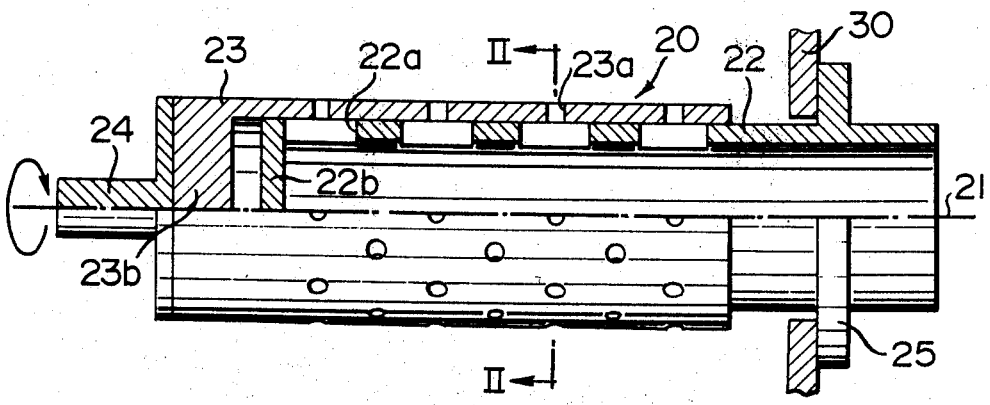
FIG. 3 is a longitudinal view partially in section of the rotary air blowing cylinder as shown in FIG. 2.

Referring to FIGS. 2 and 3, the rotary air blowing cylinder 20 is comprised of an inner cylinder 22 having a line of wide air outlets **22*a* arranged longitudinally thereon, and an outer cylinder 23 having a number of nozzles 23*a* rotatably mounted on the inner cylinder 22. The inner cylinder 22 is fixed to a stationary wall 30 and communicated with a compressed air supply (not shown). One end 22***b* of the inner cylinder 22 is closed as shown in FIG. 3. The closed end 22*b* is not necessary if the outer cylinder 23 which is rotatably mounted to the inner cylinder 22 is in air-tight engagement with the inner cylinder 22. The outer cylinder 23 is provided at an end thereof a driving shaft 24 which is connected with a driving means such as a motor (not shown). In the embodiment illustrated, the end of the outer cylinder 23 is closed as indicated at 23*b*. The inner cylinder 22 is provided with a flange 25 which is fixed to said stationary wall 30.

The air nozzles 23*a* provided on the outer cylinder 23 are arranged at equal intervals around the cylinder 23 and along the lengthwise direction of the cylinder 23 so that the air blow is periodically supplied to the stack of sheets.

As shown in FIG. 1, a stack of sheets S are vertically oriented and accumulated in the horizontal direction. The thickness of the stack of sheets S is smaller than the distance between the oppositely disposed end plates 11 and 12.

In operation of the above described device in accordance with the present invention, the rotary air blowing cylinder 20 is supplied with compressed air and the air is applied to the lower side of the stack of sheets S as an air blow from the air nozzles 23*a*. Since the inner cylinder 22 is fixed and the outer cylinder 23 is rotated thereon, the air blow is always directed upward through the wide air outlets 22*a* of the inner cylinder 22 and the air nozzles 23*a* of the outer cylinder 23 brought into alignment with the outlets 22*a*. Since the air nozzles 23*a* are arranged at equal intervals, the air blow is periodically applied to the stack of sheets S at a predetermined frequency. The periodical air blow or air pulses act to separate the sheets one by one until all sheets are separated in the sheet supporting holder 10. Since the air blow is periodically applied to the stack of sheets as air pulses, the sheets S are vibrated and caused to move horizontally in the direction to increase the thickness of the stack until the thickness becomes equal to the distance between the oppositely disposed end plates 11 and 12.

In the above embodiment, it should be noted that the direction of rotation of the outer cylinder 23 is not limited to that indicated by an arrow in FIGS. 1 and 3.

Figure 4:
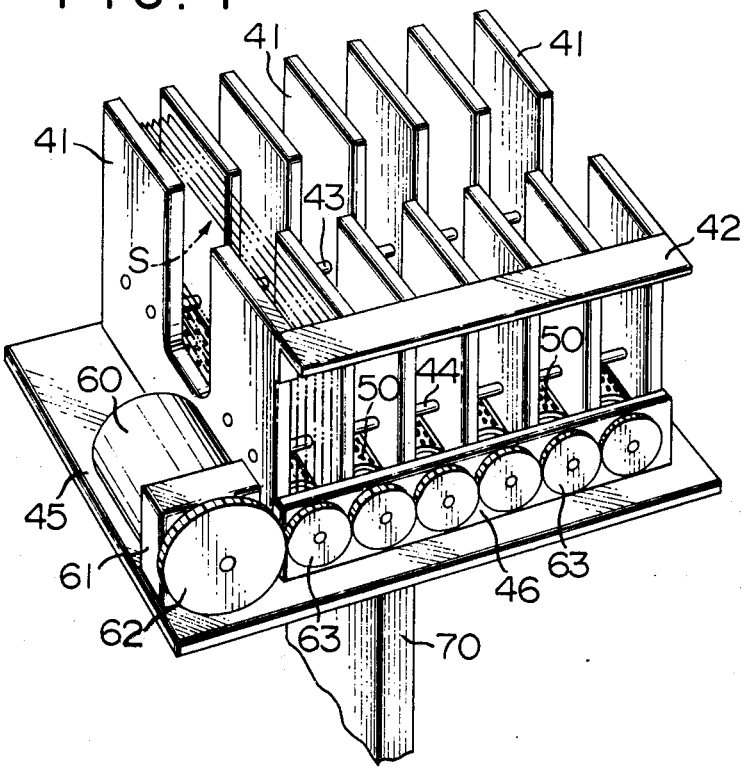
FIG. 4 is a perspective view showing a preferred embodiment of the device in accordance with the present invention.
Figure 5:
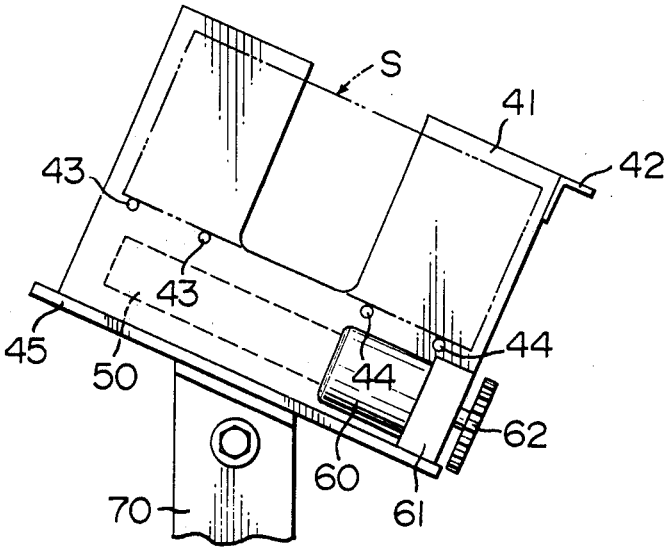
FIG. 5 is a side elevational view of the preferred embodiment of the invention as shown in FIG. 4.

A preferred embodiment of the present invention is shown in FIGS. 4 and 5. In this embodiment of the invention, the sheets are effectively aligned simultaneously with the separation thereof. Referring to FIG. 4, seven vertical plates 41 are provided in parallel to each other. The vertical plates 41 correspond to said end plates 11 and 12 shown in FIG. 1. A side plate 42 having an L-shaped cross section is fixed to the upper end of the side of the vertical plates 41. A pair of support bars 43 and another pair of support bars 44 are fixed to the lower part of the vertical plates 41 and extend therebetween to support a stack of sheets S thereby. The vertical plates 41 fixed together by the support bars 43 and 44 are mounted on a base plate 45. On the base plate 45 is installed a motor 60 provided with a driving gear 62 mechanically connected therewith by way of a reduction gear in a gear box 61. A gear train comprising six spur gears 63 is meshed with the driving gear 62. Each gear 63 of the gear train is rotatably mounted on a side plate 46 fixed to the base plate 45 and is fixed to a driving shaft (not shown) of a rotary air blowing cylinder 50. The rotary air blowing cylinder 50 is rotatably supported under the support bars 43 and 44 in quite the same way as in the structure shown in FIGS. 1 and 3. As illustrated in FIG. 4, an air blowing cylinder 50 is provided in every space between adjacent vertical plates 41. The base plate 45 is fixed to a support column 70 in an inclined position as shown in FIG. 5.

In the above described construction of the embodiment shown in FIGS. 4 and 5, the distances between adjacent vertical plates 41 are all the same and the gears 63 all ahve the same number of teeth so that all the rotary air blowing cylinders may be rotated at the same speed.

In operation of the above described preferred embodiment of the invention, six stacks of sheets S are put into the six spaces between the seven vertical plates 41 and an air blow is applied on the lower side of the stacks by the air blowing cylinders 50. As the motor 60 rotates, the rotary air blowing cylinders 50 are rotated and air blow is periodically applied to the stacks of sheets as air pulses. Since the base plate 45 is inclined as shown in FIG. 5, the sheets S are automatically aligned after being separated by the air pulses. The side ends of the sheets are aligned on the end of the side plate 42 and the lower ends of the sheets are aligned on the support bars 43 and 44.

The following data were obtained by the inventors in experiments in which stacks of X-ray film were separated by a device in accordance with the above-described preferred embodiment of the invention. Since X-ray film is provided on both surfaces thereof with a photosensitive emulsion layer, it is particularly apt to stick together. In the experiments, several stacks of X-ray film which had become stuck together after being corner-cut were used as the sheets to be separated by the device. The speed of the rotary air blowing cylinders was 30, 60 and 90 r.p.m.

The diameter of the air nozzles 23*a* was 5mm. Three air nozzles were provided on a circle around the outer cylinder 23. The base plate 45 was inclined at 30° to the horizontal plane. The air pressure of the compressed air source was $0.5 Kg/cm^2$. The size of the sheets of X-ray film was 8 × 10 feet. A stack of 150 sheets of X-ray film was put into each space between adjacent vertical plates 41. The distance between the adjacent vertical plates 41 was about 50mm, which was about twice as large as the thickness of the stack of 150 sheets of X-ray film.

In accordance with the above experiments, the time for separating all the sheets was 5 seconds when the rotary air blowing cylinders were rotated at 15 r.p.m., 7 seconds when rotated at 30 r.p.m., 10 seconds when rotated at 60 r.p.m. and 12 seconds when rotated at 90 r.p.m. These results show that the speed of the air blowing cylinder is preferably 15 to 30 r.p.m.

We claim:

1. A device for separating sheets accumulated in a stack comprising in combination:

a sheet supporting holder means including a pair of end plates and a support member extending therebetween fixed thereto, said support member supporting said sheets on the edges thereof and being provided with at least one opening for allowing an air blow to pass therethrough and between said sheets, and a rotary air blowing cylinder located under the sheet supporting holder means with the axis of rotation thereof oriented substantially parallel to said end plates, said rotary air blowing cylinder being provided with a number of air nozzles arranged regularly on the cylindrical face thereof.

2. A device for separating sheets accumulated in a stack as claimed in claim 1 wherein said support member is inclined with respect to the horizontal plane and said sheet supporting holder includes an abutment member located at the downwardly inclined side of the support member so that the sheets supported therein are automatically aligned against the abutment member by the vibration of the sheets caused by the air blow.

3. A device for separating sheets accumulated in a stack as claimed in claim 2 further comprising a side plate fixed to a side of the end plates.

4. A device for separating sheets accumulated in a stack as claimed in claim 2 wherein said support member comprises at least a pair of support bars extending perpendicular to the end plates.

5. A device for separating sheets accumulated in a stack as claimed in claim 1 wherein said rotary air blowing cylinder comprises a stationary inner cylinder having at least one air outlet, said inner cylinder being communicated with a compressed air supply, and a rotatable outer cylinder rotatably mounted on the inner cylinder concentrically therewith, said outer cylinder being provided with a number of air nozzles which are brought into alignment with said air outlet of the inner cylinder.

6. A device for separating sheets accumulated in a stack as claimed in claim 5 wherein said inner cylinder is closed at one end and open at the other end, the open end being communicated with the compressed air supply.

7. A device for separating sheets accumulated in a stack as claimed in claim 5 wherein said inner cylinder is provided with a plurality of air outlets arranged in a line in the longitudinal direction.

8. A device for separating sheets accumulated in a stack as claimed in claim 5 wherein said outer cylinder is open at one end and closed at the other end.

9. A device for separating sheets accumulated in a stack as claimed in claim 8 wherein the closed end is provided with a driving shaft extending outward along the axis of rotation of said outer cylinder.

10. A device for separating sheets accumulated in a stack as claimed in claim 1 further comprising a driving motor and a transmitting gear train connected between the driving motor and said rotary air blowing cylinder.

11. A device for separating sheets accumulated in a stack as claimed in claim 10 further comprising a base plate on which said sheet supporting holder means, said rotary air blowing cylinder, said motor and said gear train are mounted.

12. A device for separating sheets accumulated in a stack as claimed in claim 11 wherein said base plate is inclined with respect to the horizontal plane.

13. A device for separating sheets accumulated in a stack comprising a plurality of vertical plates extending in parallel to each other, a plurality of support members extending between adjacent vertical plates fixed thereto for supporting said sheets on the edges thereof, a plurality of rotary air blowing cylinders provided between adjacent vertical plates under said support members for blowing air between said sheets a plurality of gear fixed to said air blowing cylinders and meshed in a line to form a gear train, a driving motor, a driving gear associated with the driving motor and meshed with said gear train, a compressed air supply source communicated with said rotary air blowing cylinders, and a base plate on which said vertical plates and said driving motor are fixed.

14. A device for separating sheets accumulated in a stack as claimed in claim 13 wherein said base plate is inclined with respect to the horizontal plane, and a side plate is fixed to one side of said vertical plates at the downwardly inclined side of said base plate to make the side ends of the sheets aligned.

* * * * *